US008070512B2

(12) United States Patent
Xuan et al.

(10) Patent No.: US 8,070,512 B2
(45) Date of Patent: Dec. 6, 2011

(54) STACKED USB 3.0 CONNECTOR HAVING A LENGTH EQUAL TO THAT OF STACKED USB 2.0 CONNECTOR

(75) Inventors: Wan-Li Xuan, Kunshan (CN); Dao-Kuan Zhang, Kunshan (CN); Wei-Kang Liu, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/878,041

(22) Filed: Sep. 9, 2010

(65) Prior Publication Data

US 2011/0065315 A1 Mar. 17, 2011

(30) Foreign Application Priority Data

Sep. 17, 2009 (CN) ..... 2009 1 0307126

(51) Int. Cl.
*H01R 13/60* (2006.01)
*H01R 13/66* (2006.01)

(52) U.S. Cl. ..... 439/541.5; 439/79

(58) Field of Classification Search ..... 439/79, 439/607.01, 607.02, 540.1, 541.5, 660, 676
See application file for complete search history.

(56) References Cited

U.S. PATENT DOCUMENTS 6,162,089 A 12/2000 Costello et al.
7,651,371 B2 1/2010 Yi et al.
2005/0255746 A1 * 11/2005 Hyland ..... 439/541.5
* cited by examiner

*Primary Examiner* — Javid Nasri
(74) *Attorney, Agent, or Firm* — Ming Chieh Chang; Wei Te Chung; Andrew C. Cheng

(57) ABSTRACT

A stacked electrical connector (100) has a mounting face to be mounted on a printed circuit board (80). The stacked electrical connector (100) comprises an insulating housing (20) defining a mating port (220) for mating with a mating plug and a cavity (222) below the mating port (220) in a front face (22), and a stacked USB 3.0 connector (40) received in the cavity (222) of the insulating housing (20). The stacked USB 3.0 connector (40) has two stacked mating ports (425, 427) aligned with the mating port (220) of the insulating housing (20) along the front face (22). The cavity (222) extends rearwardly from the front face (22) a front-to-back length (L) equaling a corresponding length of a stacked USB 2.0 connector.

12 Claims, 11 Drawing Sheets

STACKED USB 3.0 CONNECTOR HAVING A LENGTH EQUAL TO THAT OF STACKED USB 2.0 CONNECTOR

BACKGROUND OF THE INVENTION

1. Field of the Invention

The present invention relates to an electrical connector, and particularly, to an electrical connector of a reduced front-to-back length.

2. Description of Related Art

The Universal Serial Bus (USB) is a standardized interface for data communications between electronic devices. Electronic devices which incorporate the USB may communicate with each other utilizing standard connectors and interface protocols.

The USB as originally designed is based on a master-slave protocol wherein a host system (master) may connect to one or more peripheral devices (slaves) in a tiered star topology. The host system may control several peripheral devices through a series of hubs. The host system determines how connections and communications are made to the peripheral devices, and therefore the intelligence resides primarily in the host system.

There have been several USB standard specifications, such as USB 1.0, USB 2.0 and USB 3.0. A stacked USB 3.0 connector is disclosed in U.S. Pat. No. 7,651,371, which is issued on Jan. 26, 2010 to Yi et al. The stacked USB 3.0 connector has a length longer than the length of a stacked USB 2.0 or USB 1.0 connector. Additionally, stacked USB connectors are often used to be combined with modular jacks, RJ45 for example, as is disclosed in U.S. Pat. No. 6,162,089, issued on Dec. 19, 2000 to Costello et al. Thus, a stacked USB 3.0 connector could not be readily used in for example existing stacked USB 2.0 connector and modular jack combo due to its longer length.

SUMMARY OF THE INVENTION

An object of the present invention is to provide an electrical connector stacked with a stacked USB 3.0 connector, wherein the stacked USB 3.0 could be interchanged with a stacked USB 2.0 connector. The electrical connector comprises an insulating housing defining a mating port for mating with a complementary connector and a cavity below the mating port in a front face, a stacked USB 3.0 connector received in said cavity of the insulating housing, the stacked USB 3.0 connector having two stacked mating ports aligned with the mating port of the insulating housing along the front face. The cavity extends rearwardly from the front face a length equaling a corresponding length of a stacked USB 2.0 connector.

Still another object of the present invention is to provide an electrical connector having a short length. The electrical connector comprises a base, a first row of contacts, a tongue board and a second row of contacts. The base has a first rear vertical face, a second rear vertical face above the first rear vertical face, a plurality of slots in the first rear vertical face, and a fastening slot rearwardly extending till the second rear vertical face. The first row of contacts extend rearwardly out from the first rear vertical face and having tails bent downwardly. The tongue board is assembled in the fastening slot and extending till the second rear vertical face. The second row of contacts are molded with the tongue board and extends rearwardly out from the second rear vertical face and having tails bent downwardly.

Other objects, advantages and novel features of the invention will become more apparent from the following detailed description of a preferred embodiment when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
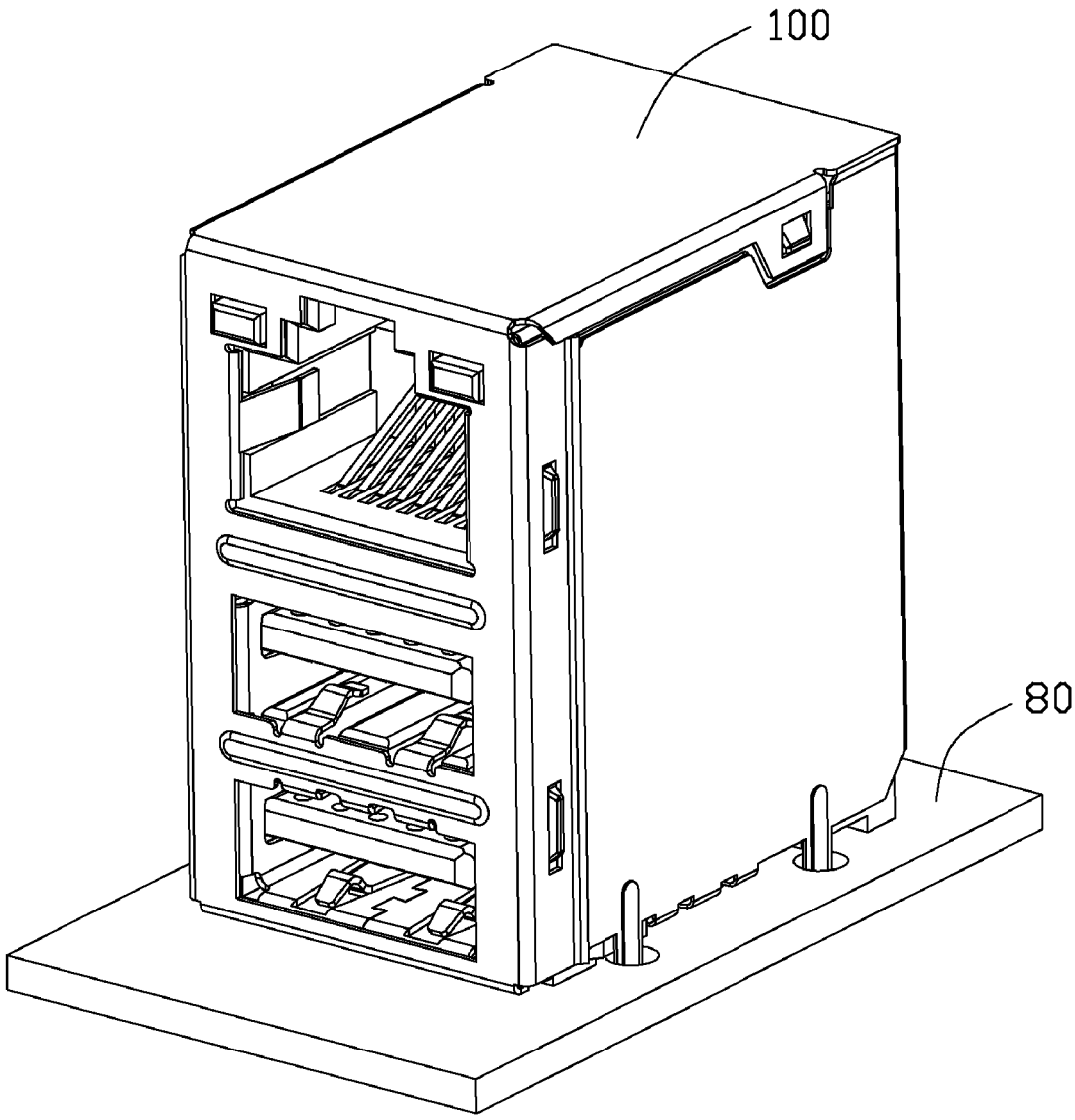
FIG. 1 is a perspective view of a stacked electrical connector according to an embodiment of present invention.

Reference will now be made to the drawing figures to describe the present invention in detail.

Referring to FIG. 1, a stacked electrical connector 100 according to an embodiment of the present invention is shown. The stacked electrical connector 100 is mounted on a printed circuit board 80.

Figure 2:
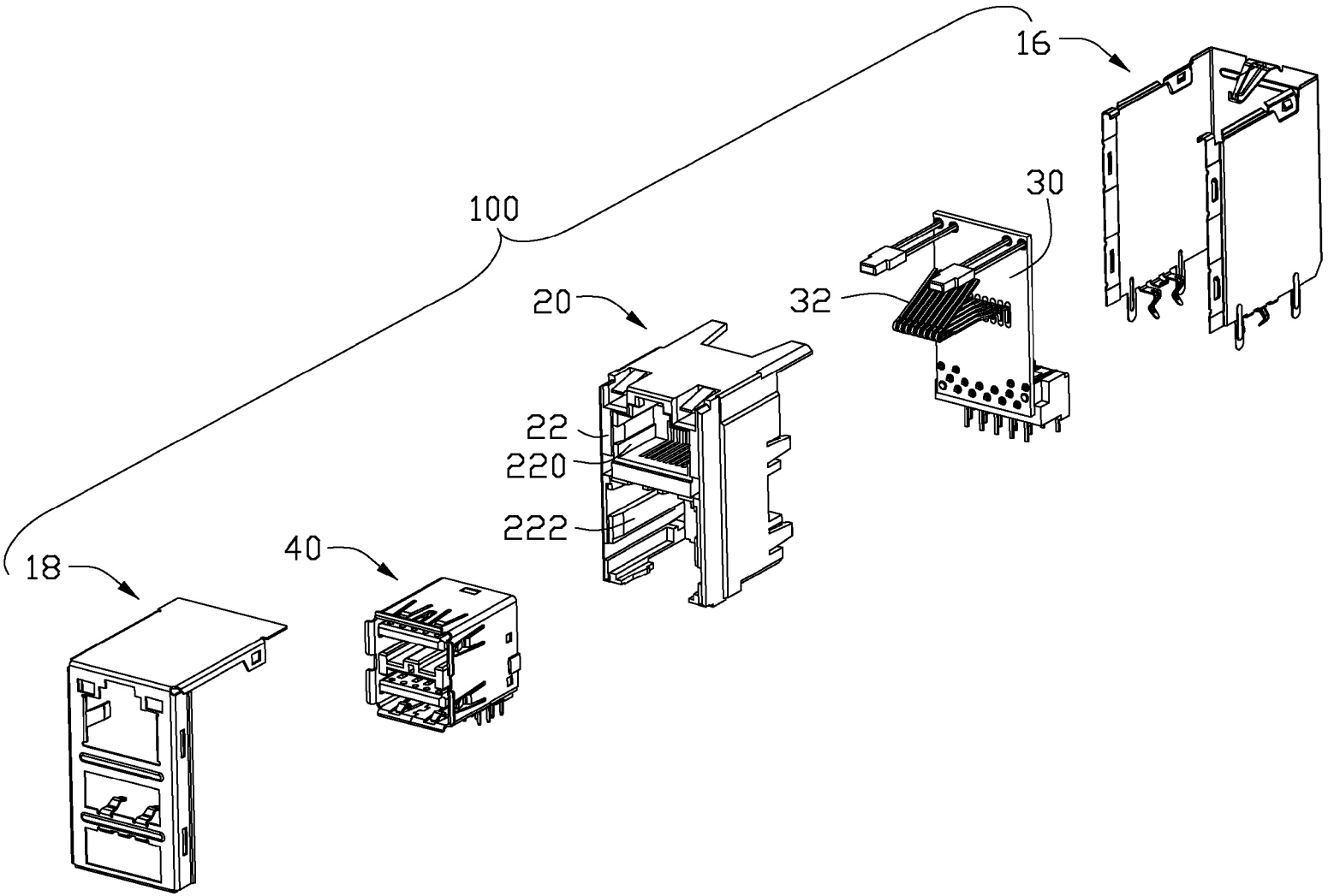
FIG. 2 is an exploded perspective view the stacked electrical connector shown in FIG. 1.

Referring to FIG. 2, the stacked electrical connector 100 includes an insulating housing 20, a contact module 30 received in the insulating housing 20, a stacked USB 3.0 connector 40 assembled to the insulating housing 20, and two metal shields 16, 18 covering the insulating housing 20.

Figure 3:
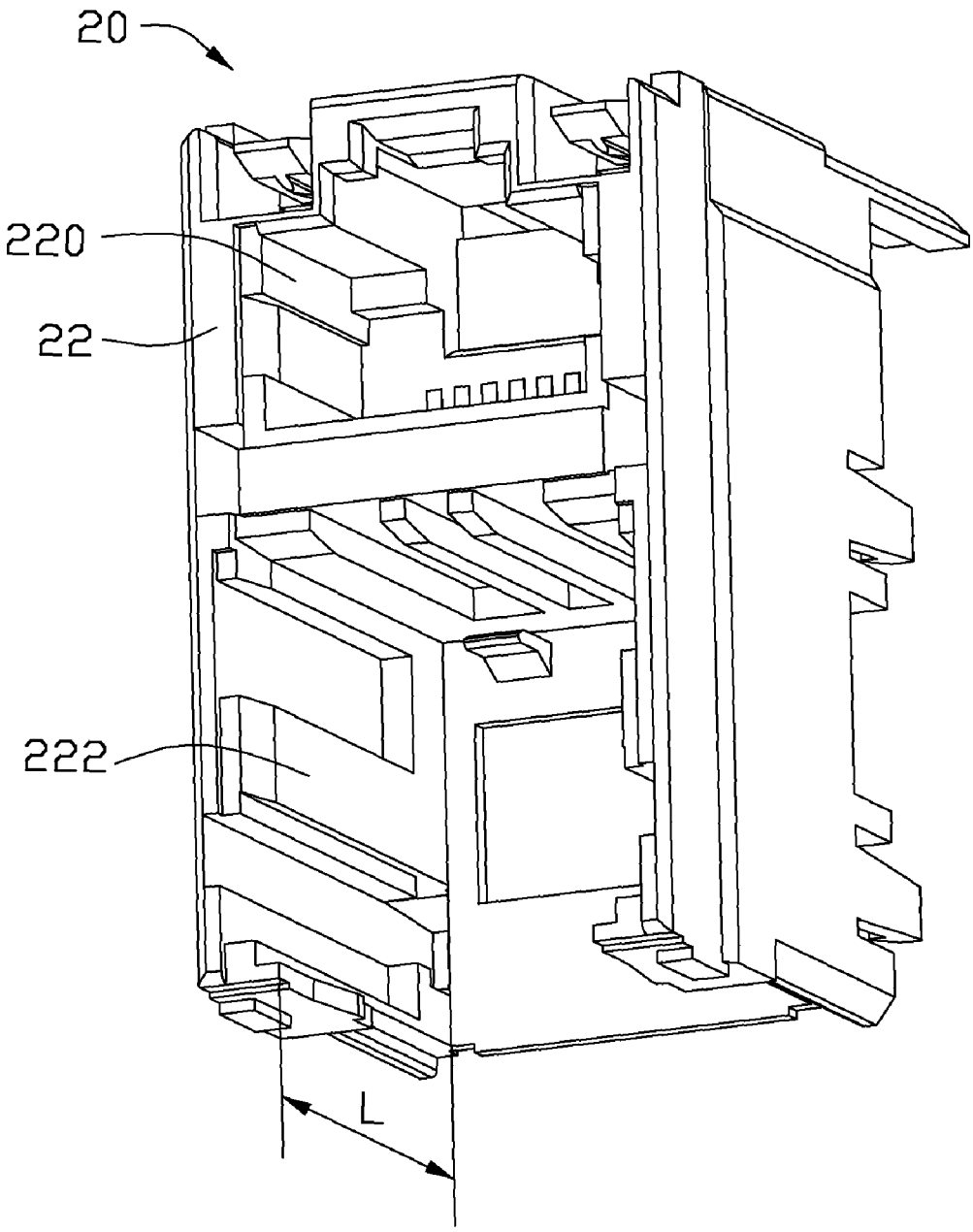
FIG. 3 is a perspective view of an insulating housing shown in FIG. 2.
Figure 4:
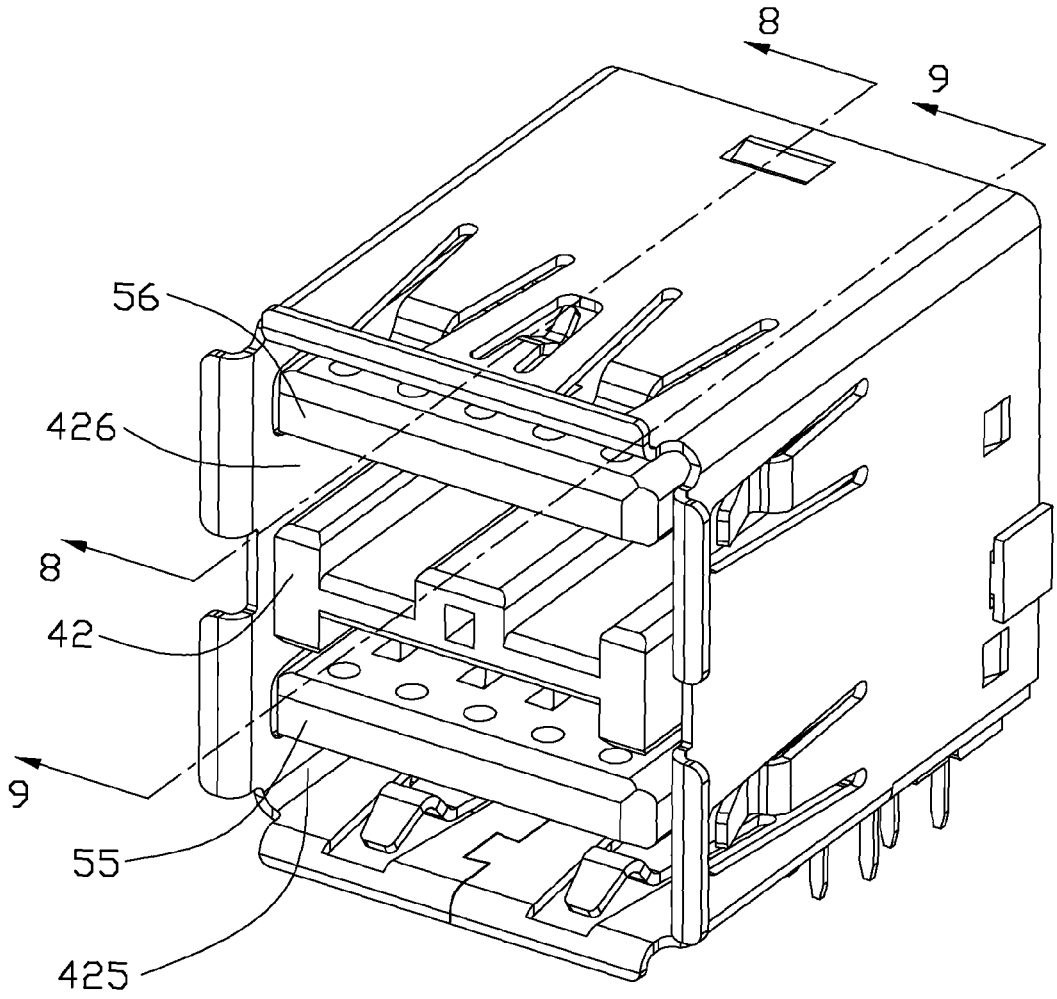
FIG. 4 is a perspective view of a stacked USB 3.0 connector shown in FIG. 2.
Figure 5:
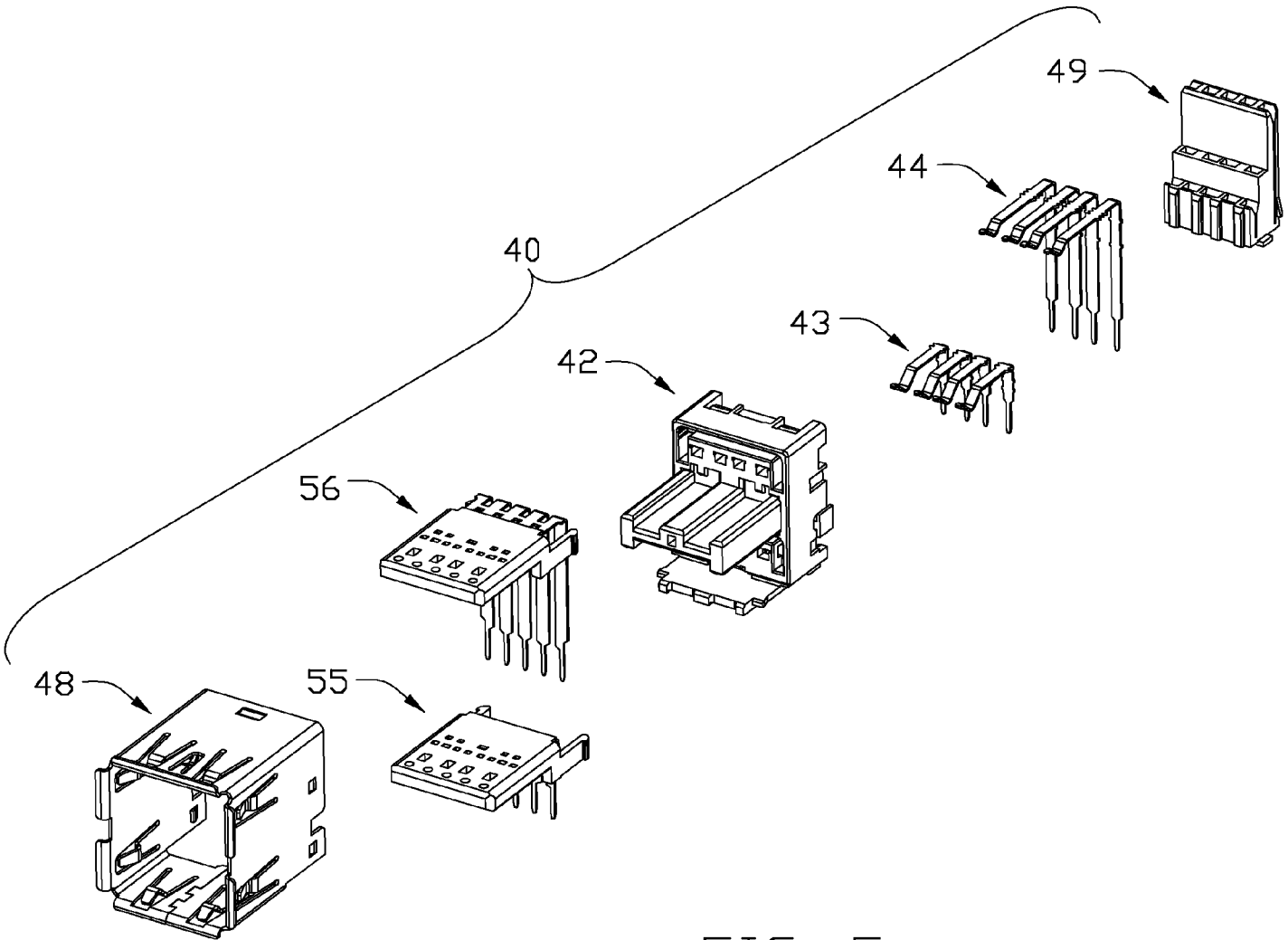
FIG. 5 is an exploded perspective view of the stacked USB 3.0 connector shown in FIG. 4.
Figure 6:
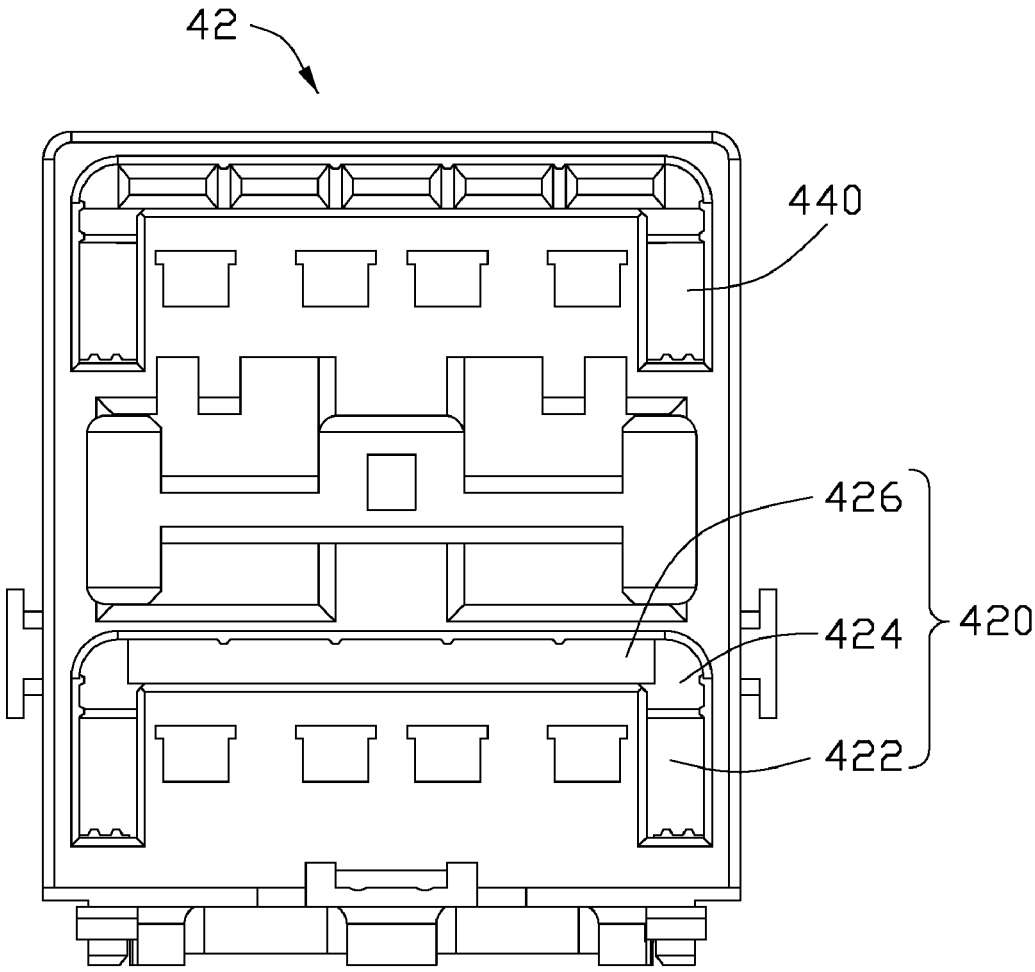
FIG. 6 is a front view of the base shown in FIG. 5.
Figure 7:
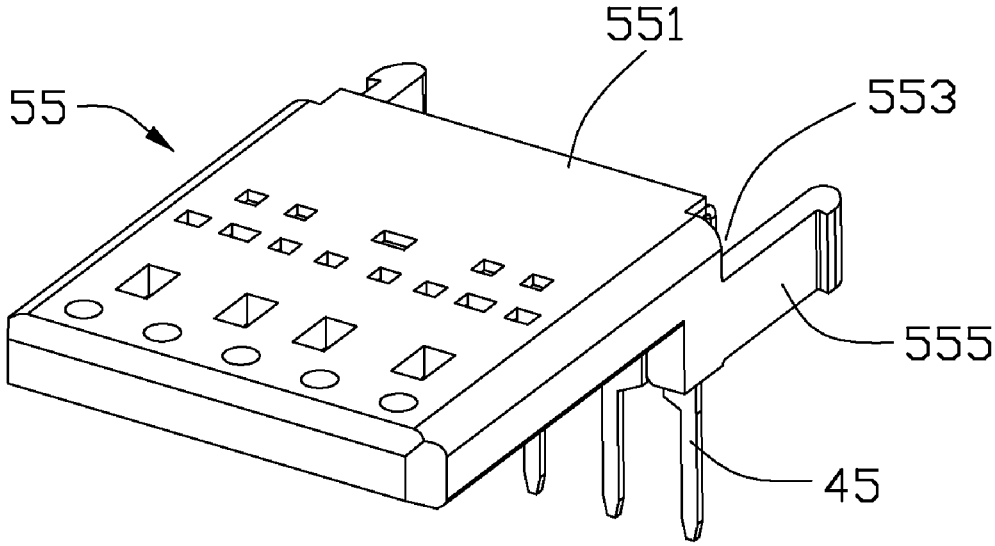
FIG. 7 is a perspective view of a lower tongue board molded with a plurality of contacts.
Figure 8:
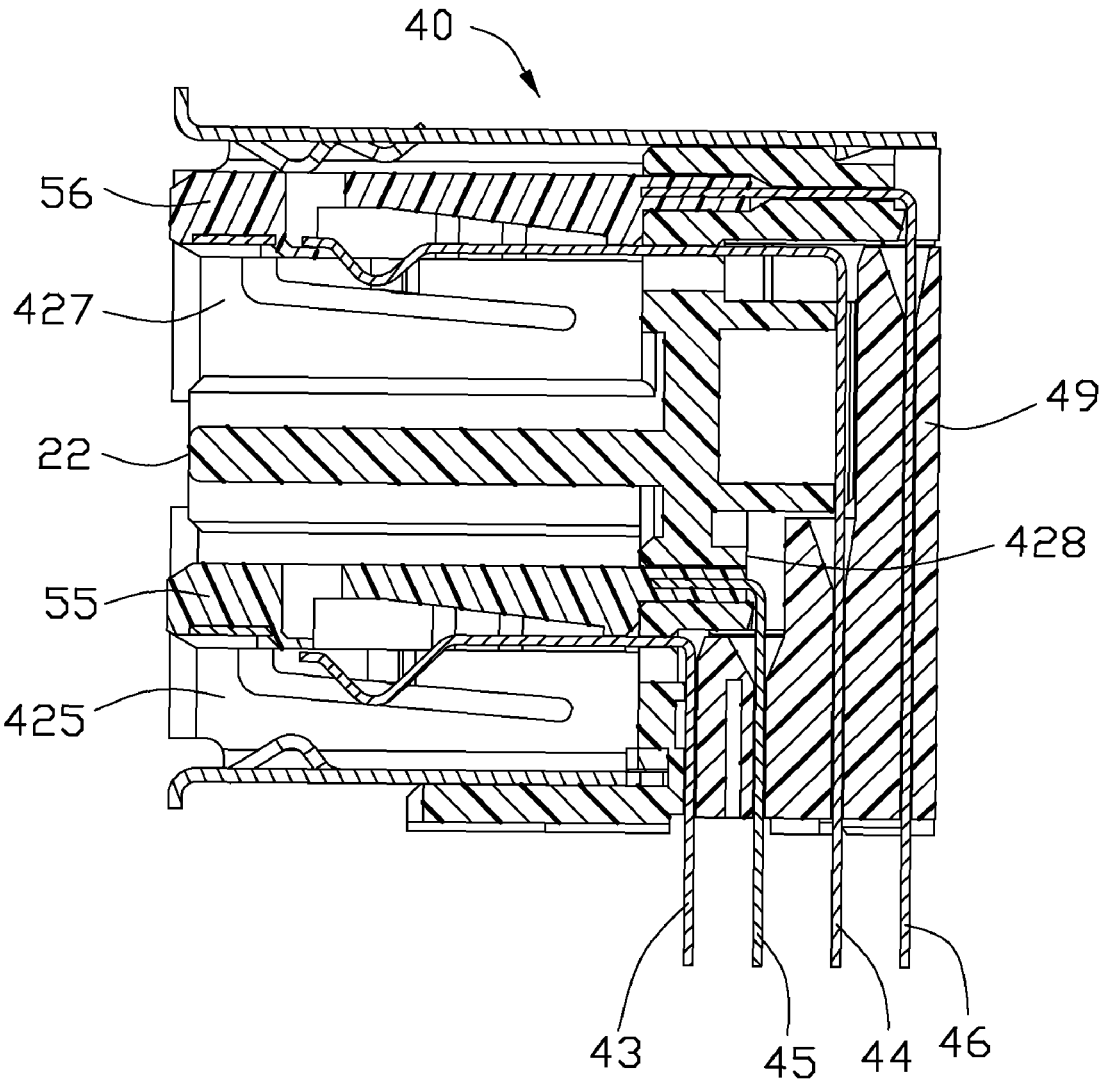
FIG. 8 is a cross-section of the stacked USB 3.0 connector taken along line 8-8 in FIG. 4.
Figure 9:
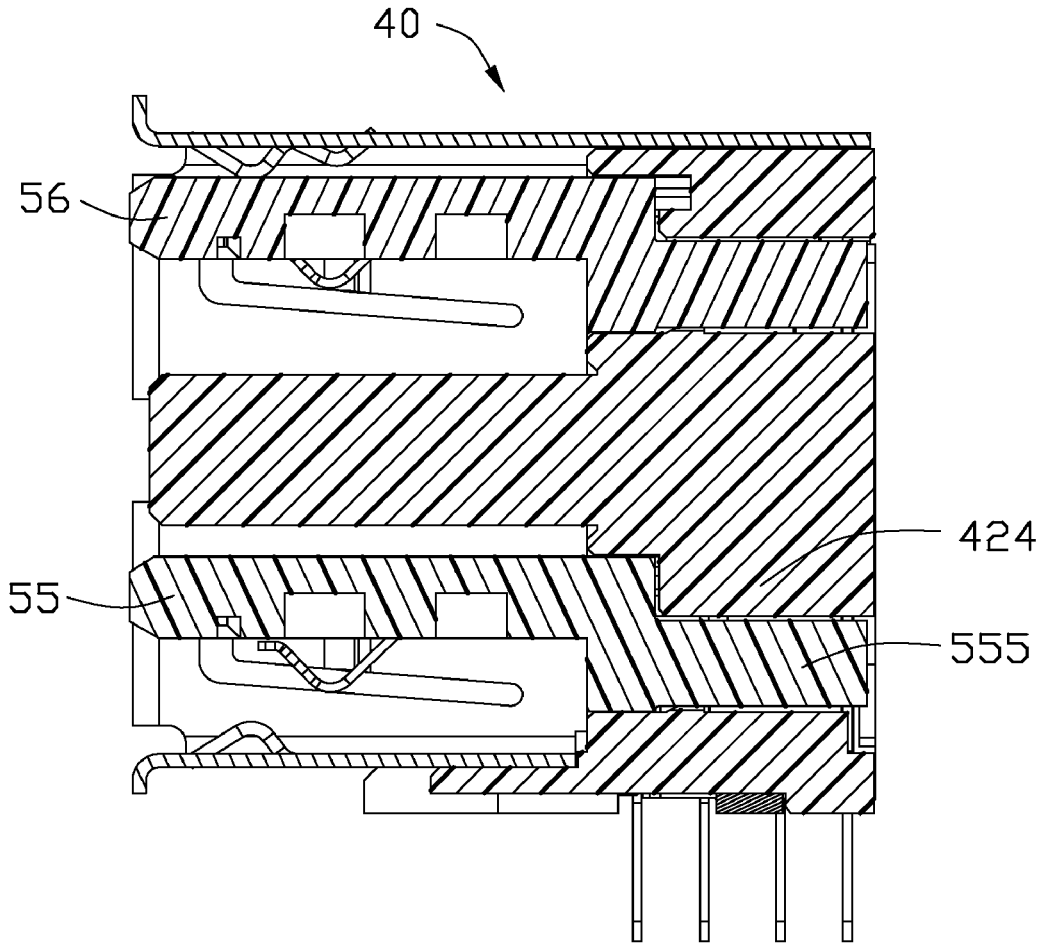
FIG. 9 is a cross-section of the stacked USB 3.0 connector taken along line 9-9 in FIG. 4.
Figure 10:
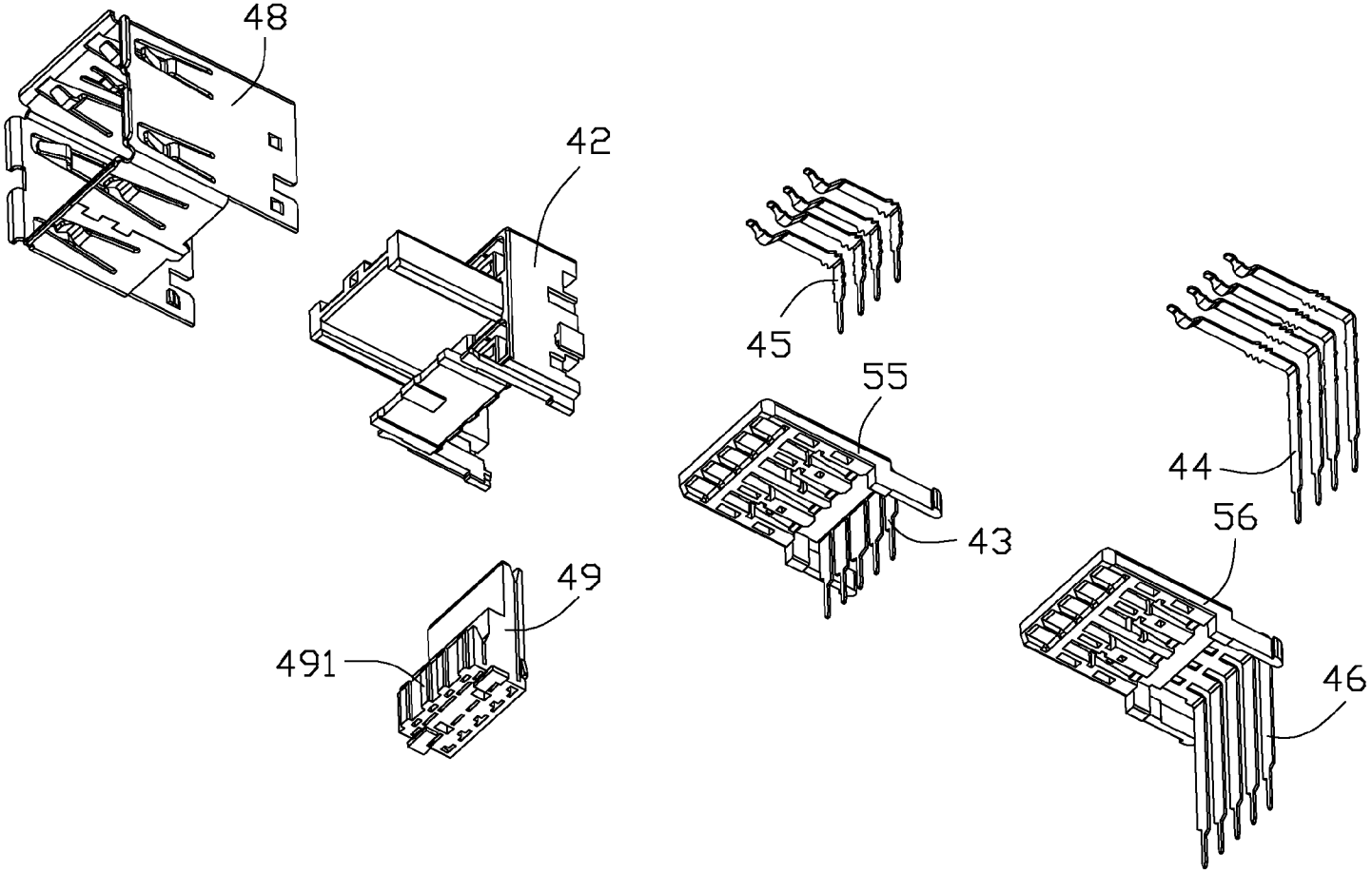
FIG. 10 is another exploded perspective view of the stacked USB 3.0 connector shown in FIG. 4.
Figure 11:
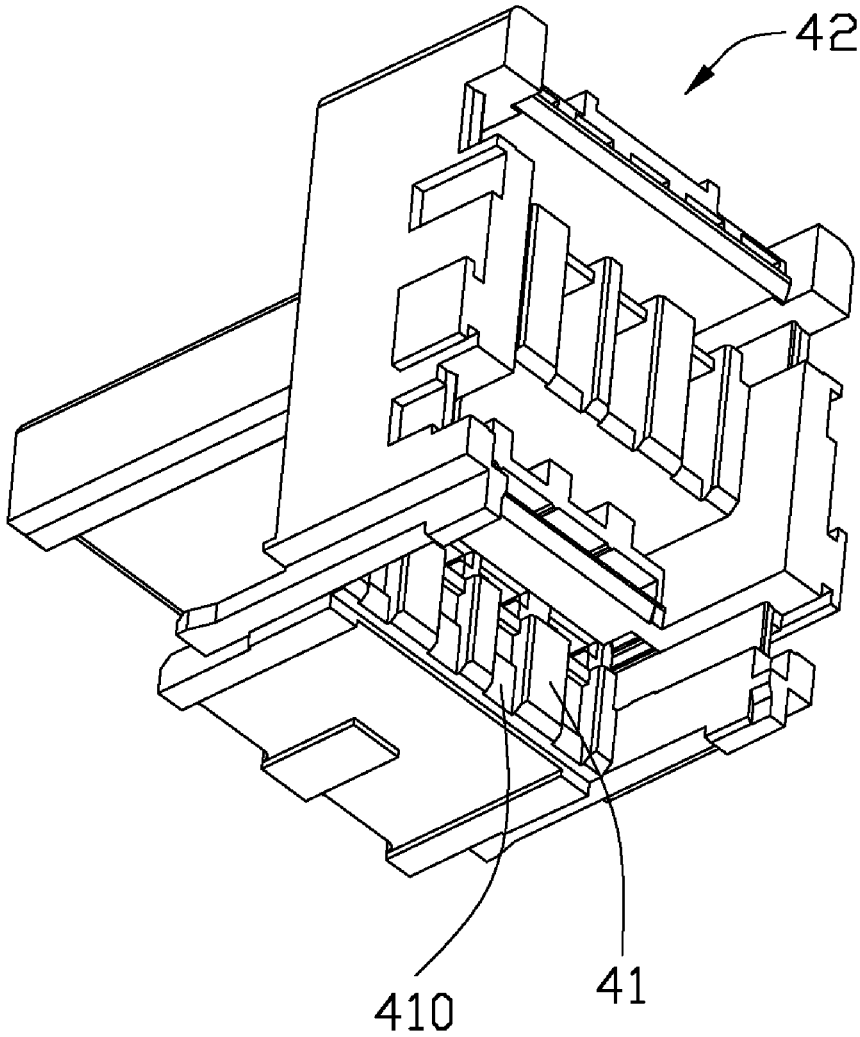
FIG. 11 is a perspective view of the base shown in FIG. 10.

Referring to FIGS. 2 and 3, the insulating housing 20 defines a mating port 220 for mating with a RJ plug (not shown) and a cavity 222 below the mating port 220 in a front face 22. The contact module 30 has eight RJ contacts 32 extending into the mating port 220 for electrically contacting the RJ plug. The cavity 222 rearwardly extends from the front face 22 a length L equaling a corresponding length of a stacked USB 2.0 connector (not shown), so that a stacked USB 2.0 connector could be interchangeably received in the cavity 222.

Referring to FIGS. 4-11, the stacked USB 3.0 connector 40 has two stacked mating ports 425, 426 aligned with the mating port 220 along the front face 22. The stacked USB 3.0 connector includes a base 42, a first row of electrical contacts 43 and a third row of electrical contacts 44 assembled to the base 42, a lower tongue board 55 molded with a second row of electrical contacts 45, an upper tongue board 56 molded with a fourth row of electrical contacts 46, a spacer 49 positioning tails of the rows of the electrical contacts 43-46, and a metal shell 48 covering the base 42. The lower tongue board 55 is assembled to the base 42 at a position above the first row of electrical contacts 43, and the upper tongue board 56 is assembled to the base at a position above the third row of electrical contacts 44.

The base defines a first rear vertical face 41, a second rear vertical face 428 rearwardly offset from the first rear vertical face 41, a lower fastening slot 420 extending up to the second rear vertical face 428, and an upper fastening slot 440 above the lower fastening slot 420. The two tongue boards 55, 56 are respectively received in the lower fastening slot 420 and the upper fastening slot 440. The lower tongue board 55 extends up to the second rear vertical face 428, so that the lower fastening slot 420 has a longer mating length in the lower fastening slot 420.

The second row of electrical contacts 45 includes five electrical contacts lined up horizontally, and the first row of electrical contacts 43 includes four electrical contacts horizontally aligned below the second row of electrical contacts 45 and the lower tongue board 55. The lower tongue board 55 is formed with two spring latches 555 connected to two opposite sides thereof. The two spring latches 555 are disposed below the lower tongue board 55 and extend backwardly for snap-in mating with the base 42. Each of the spring latches 555 and a rear end 551 of the lower tongue board 55 defines a respective space 553 therebetween. The base 42 has two blocks 424 at two opposite sides of the lower fastening slot 42 and the two blocks 424 divide the lower fastening slot 42 into a board receiving portion 426 and two latch receiving portions 422. The block 424 is received in the space 553 and positions the lower tongue board 55 when the tongue board 55 is inserted into the lower fastening board 420. It is noted that the second rear vertical face 428 is rearwardly offset to a position behind the tails of the first row of electrical contacts 43 so that the mating length between the lower fastening slot 420 and the lower tongue board 55 is lengthened.

The spacer 49 is assembled to the base 42 and abutting the spring latches 555 to prevent the spring latches 555 from being released from the base 42. The tails of the four rows of electrical contacts 43-46 extend downwardly to be mounted into holes of the printed circuit board 80. The base 42 defines four slots 410 in the first rear vertical face to receive the tails of the first row of electrical contacts 43. The spacer 49 has four ribs 491 protruding into the slots 410 and abutting the tails of the first row of electrical contacts 43 therein.

It is preferred that the stacked USB 3.0 connector has a front-to-back length between 16.9 millimeters and 17.3 millimeters, which is equal to the length L of the cavity 222, so that the stacked USB 3.0 connector 40 could be interchanged with a USB 2.0 connector used in a conventional USB 2.0 and modular jack combo.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulating housing defining a mating port for mating with a complementary connector and a cavity below the mating port in a front face thereof;

a stacked USB 3.0 connector received in said cavity of the insulating housing, the stacked USB 3.0 connector having a length equal to that of a stacked USB 2.0 connector and having two mating ports aligned with the mating port of the insulating housing along the front face;

wherein the cavity extends rearwardly from the front face a length equal to the length of the stacked USB 3.0 connector;

wherein the stacked USB 3.0 connector has a base and two tongue boards, the base defining a rear vertical face, a lower fastening slot and an upper fastening slot for fastening the two tongue boards respectively therein, the lower fastening slot and associated tongue board extending up to the rear vertical face;

wherein the base is assembled with a first row of contacts horizontally lined below the lower fastening slot, and the lower tongue board is molded with a second row of contacts horizontally lined therein.

2. An electrical connector as claimed in claim 1, wherein the base is assembled with a third row of contacts horizontally lined below the upper fastening slot, and the upper tongue board is molded with a fourth row of contacts horizontally lined therein.

3. An electrical connector as claimed in claim 1, wherein the lower tongue board is formed with two spring latches at two opposite sides thereof, the two spring latches being disposed below the lower tongue board and extending backwardly for snap-in mating with the base.

4. An electrical connector as claimed in claim 3, wherein each of the spring latches and a rear end of the lower tongue board define a respective space therebetween, and the base has two blocks in the lower fastening slot, the block being disposed in said space.

5. An electrical connector as claimed in claim 4, wherein the stacked USB 3.0 connector further comprises a spacer assembled to the rear vertical face of the base and abutting the spring latches to prevent the spring latches from being released from the base.

6. An electrical connector as claimed in claim 5, wherein the stacked USB 3.0 connector comprises a first row of contacts extending out from the rear vertical face and having tails bent downwardly, the base defining a plurality of slots in the rear vertical face, the slots respectively receiving the tails of the contacts, the spacer having ribs protruding into the slots and abutting the tails of the first row of contacts.

7. An electrical connector comprising:

a base having a first rear vertical face, a second rear vertical face above and behind the first rear vertical face, a plurality of slots in the first rear vertical face, and a fastening slot rearwardly extending up to the second rear vertical face, a first row of contacts extending rearwardly out from the first rear vertical face and having tails bent downwardly;

a tongue board being assembled in the fastening slot and extending up to the second rear vertical face;

a second row of contacts being molded with the tongue board and extending rearwardly out from the second rear vertical face and having tails bent downwardly; and a spacer assembled to the base, the tails of the first row of contacts being respectively received in the slots in the first rear vertical face, the spacer having ribs protruding into the slots and abutting the tails of the first row of contacts;

wherein the tongue board has two spring latches connected at two opposite sides thereof, the spring latch extending backwardly for snap-in latching onto the base.

8. An electrical connector as claimed in claim 7, wherein each of the spring latches and a rear end of the tongue board define a respective space therebetween, the base having a respective block at one of two opposite sides of the fastening slot, the block being disposed in said space.

9. An electrical connector as claimed in claim 8, wherein the spacer abuts the spring latches to prevent the spring latches from being released from the base.

10. An electrical connector as claimed in claim 7, wherein the base is assembled with a third row of contacts above the second row of contacts and another tongue board molded with a fourth row of contacts above the third row of contacts.

11. An electrical connector comprising:

an insulative housing including a vertical wall, a horizontal partition wall unitarily extending forwardly from a middle portion of the vertical wall to form upper and lower mating ports beside said horizontal partition wall;

a frame like metallic shell enclosing said housing and the associated upper and lower mating ports so as to expose said upper and lower mating ports forwardly in a horizontal direction only;

an upper mating tongue discrete from the housing and extending through the vertical wall from a rear side thereof and inserted into the upper mating port;

a plurality of upper contacts disposed in the upper mating tongue;

a lower mating tongue discrete from the housing and extending through the vertical wall from the rear side thereof and inserted into the lower mating port;

a plurality of lower contacts disposed in the lower mating tongue; and said housing defines a bottom wall exposed under a bottom portion of the shell for being seated upon a printed circuit board;

wherein some of the upper contacts are integrally formed with the upper mating tongue, and some of the lower contacts are integrally formed with the lower mating tongue.

12. The electrical connector as claimed in claim 11, wherein said vertical wall defines a downwardly exposed cavity to receive therein a spacer which aligns contacts tails of both the upper contacts and the lower contacts.

* * * * *